US005655186A

United States Patent [19]

Godlove et al.

[11] Patent Number: 5,655,186

[45] Date of Patent: Aug. 5, 1997

[54] LIGHT BLOCKING ION CHARGING APPARATUS

[75] Inventors: Ronald E. Godlove, Bergen; Robert W. Gundlach, Victor; Richard F. Bergen, Ontario, all of N.Y.

[73] Assignee: Xerox Corporation, Stamford, Conn.

[21] Appl. No.: 623,498

[22] Filed: Mar. 28, 1996

[51] Int. Cl.[6] ..... G03G 15/02

[52] U.S. Cl. ..... 399/171; 250/325

[58] Field of Search ..... 355/221, 225; 250/324–326; 361/225, 229; 347/123; 399/171, 170, 172, 173

[56] References Cited

U.S. PATENT DOCUMENTS

| | | | |
|---|---|---|---|
| 2,588,699 | 3/1952 | Carlson | 95/1.9 |
| 2,777,957 | 1/1957 | Walkup | 250/19.5 |
| 3,598,991 | 8/1971 | Nost | 250/49.5 |
| 3,942,079 | 3/1976 | Brock . | |
| 3,983,393 | 9/1976 | Thettu et al. | 250/326 |
| 4,086,650 | 4/1978 | Davis et al. | 361/229 |
| 4,100,411 | 7/1978 | Davis | 250/324 |
| 4,155,093 | 5/1979 | Fotland et al. | 346/159 |
| 4,174,170 | 11/1979 | Yamamoto et al. . | |
| 4,463,363 | 7/1984 | Gundlach et al. | 346/159 |
| 4,524,371 | 6/1985 | Sheridan et al. | 346/159 |
| 4,763,141 | 8/1988 | Gundlach et al. . | |
| 4,841,146 | 6/1989 | Gundlach et al. | 250/324 |
| 4,910,637 | 3/1990 | Hanna | 361/229 |
| 5,083,145 | 1/1992 | Gundlach et al. . | |
| 5,206,784 | 4/1993 | Kimiwada et al. | 361/229 |
| 5,411,825 | 5/1995 | Tam | 430/41 |
| 5,504,560 | 4/1996 | Kitagaki et al. | 355/215 |

*Primary Examiner*—Robert Beatty
*Attorney, Agent, or Firm*—William A. Henry, II

[57] ABSTRACT

A charging apparatus that prevents fogging due to light generated by a corona source. The charging apparatus includes two offset reference electrodes lying in separate horizontal planes or a light eclipsing element positioned between a corona source and an electrode member.

23 Claims, 3 Drawing Sheets

LIGHT BLOCKING ION CHARGING APPARATUS

BACKGROUND OF THE INVENTION

1. Field of the Invention

This invention relates to a novel ion charging apparatus wherein ions are generated in a housing and passed through a narrow conducting exit slit in order to uniformly charge a charge receptor.

Corona charging of xerographic photoreceptors has been disclosed as early as U.S. Pat. No. 2,588,699. It has always been a problem that current levels for practical charging require coronode potentials of many thousands of volts, while photoreceptors typically cannot support more than 1000 volts surface potential without dielectric breakdown.

One attempt at controlling the uniformity and magnitude of corona charging is U.S. Pat. No. 2,777,957 which makes use of an open screen as a control electrode, to establish a reference potential, so that when the receiver surface reaches the screen voltage, the fields no longer drive ions to the receiver, but rather to the screen. Unfortunately, a low porosity screen intercepts most of the ions, allowing a very small percentage to reach the intended receiver. A more open screen, on the other hand, delivers charge to the receiver more efficiently, but compromises the control function of the device.

Other methods exist for trying to obtain uniform charging from negative charging systems such as dicorotron charging devices as shown in U.S. Pat. No. 4,086,650 that includes glass coated wires and large specialized AC power supplies. A self cleaning charging unit is disclosed in U.S. Pat. No. 4,841,146 that includes an insulating housing with conductive plates attached to a bottom surface thereby forming a slit for the passage of ions from a corona source positioned within the housing toward a receptor surface. The housing includes insulating wedges positioned above and in contacting relation with each conductive plate in order to focus additional ions toward the center of the slit.

Various ion generating devices are available for printing or charging purposes. For example, in U.S. Pat. No. 4,463,363 there is taught a D.C. air breakdown form of ion generator. In U.S. Pat No. 4,524,371 a fluid jet assisted ion projection printing apparatus is disclosed that includes a housing having ion generation and ion modulation regions. A bent path channel, disposed through the housing, directs transport fluids with ions entrained therein adjacent an array of modulation electrodes which control the passage of ion beams from the device. Emission of charged particles in U.S. Pat. No. 4,155,093 is accomplished by extracting them from a high density source provided by an electrical gas breakdown in an alternating electrical field between two conducting electrodes separated by an insulator. A corona discharge unit is used in conductive toner transfer in a copier in U.S. Pat. No. 4,174,170. The corona discharge unit includes a slit to permit transfer of conductive toner particles onto a copy paper charged by the corona unit. A corona wire in the unit is surrounded by a shield. U.S. Pat. No. 3,396,308 discloses a web treating device for generating a flow of ionized gas. This device includes an opening through which the gas is directed towards a receptor surface. An elongated hollow hosing 11 has tapered sides 14 terminating in a pair of lips 15 which form a narrow and elongated slot 16. U.S. Pat. Nos. 3,598,991 and 4,100,411 show electrostatic charging devices including a corona wire surrounded by a conductive shield. In U.S. Pat. No. 3,598,991, a slit 13 is formed in the shield to allow ions to flow from wire 12 to a photoconductive surface 2 to deposit an electric charge thereon. In U.S. Pat. No. 4,100,411, a pair of lips 16 and 17 define a corona ion slit 18. Japanese Patent Document No. 55-73070 discloses a powder image transfer type electrostatic copier that includes a corona discharge device having a slit in a shield plate. In Japanese Patent Document No. 54-156546 a corona charge is shown having a plurality of grating electrodes in the opening part of a corona shield electrode. These devices have not been entirely satisfactory in that they are costly, some of them are hard to fabricate and most are inefficient.

In addition, the problem of uniformity of charge is more pronounced when migration imaging is attempted using Verde film that is disclosed in U.S. Pat. No. 5,411,825. In contrast to typical copier/printer speeds which are nearer to 4 inches per second, the process speed for Verde film is very slow and at times less than 4 inches per minute. Consequently, Verde film light sensitivity requires approximately 3.5 times less light for exposure than some photoreceptors. With Verde film traveling at 4 inches per minute beneath the corona, fogging as a result of exposure from corona generated light is a major problem.

Accordingly, a charging apparatus is provided for use in any of the various printing and imaging processes. The light blocking ion charging apparatus of the present invention overcomes the above-described problems and disadvantages of conventional charging devices.

Specifically, this invention in one embodiment provides a charging device with a light eclipsing element juxtaposed between a corona source and a charge receptor. The light eclipsing element blocks the corona generated light without unduly affecting the performance of the charging device.

In another embodiment, the charging apparatus of the present invention includes a corona source and a conducting grid of parallel screen wires on the like spaced between the conducting screen and a charge receptor. Eclipsing rods or wires are positioned between the corona source and conducting screen and spaced so that their shadows fall in the spaces between the grid of parallel screen wires to thereby intercept corona light while allowing the flow of ions from the corona source to the charge receptor.

In yet another embodiment, the charging apparatus of the present invention includes a corona generating source, an eclipse element along with two conductive, semiconductive, or insulating wedges that focus ion emanating from the corona generating source toward a pair of conductive slit forming electrodes. The eclipse element prevents light emitted from the corona generating source from exiting the slit.

Other features of the present invention will become apparent as the following description proceeds and upon reference to the drawings in which.

Figure 1:
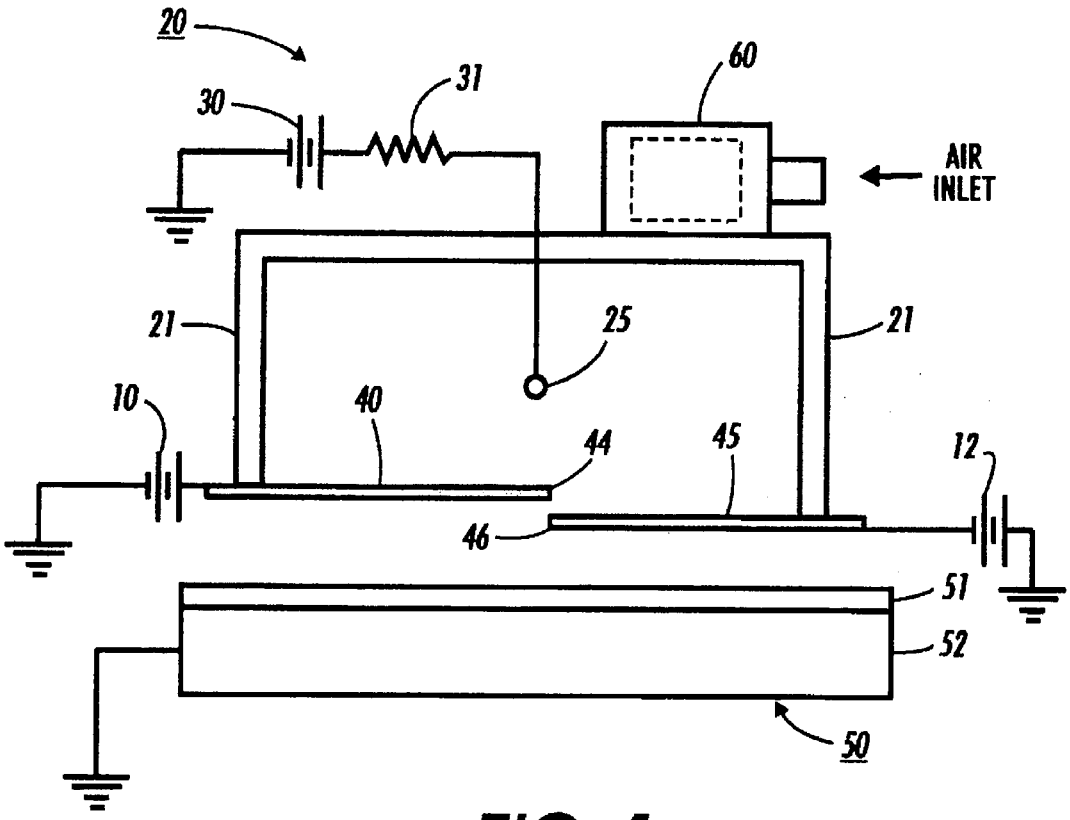
FIG. 1 is an enlarged elevational view of a self-cleaning charging unit that incorporates light blocking electrodes in the unit in accordance with one aspect of the present invention.

While the invention will be described hereinafter in connection with preferred embodiments, it will be understood that no intention is made to limit the invention to the disclosed embodiments. On the contrary, it is intended to cover all alternatives, modifications, and equivalents as may be included within the spirit and scope of the invention as defined by the appended claims.

For a general understanding of the features of the invention, reference is had to the drawings. In the drawings, like reference numerals have been used throughout to designate identical elements.

In accordance with an aspect of the present invention, FIG. 1 depicts a novel charging unit 20 that comprises an insulating housing 21 that is rectangular in shape with 2 mil thick conductive plates 40 and 45 provided as a bottom position thereof. The bottom plates 40 and 45 are offset to provide fields to enable charges to flow around their edges and reach charge receptor 50. The plates also provide a light trap in order to prevent exposure of the film to visible and ultraviolet emissions from corona source 25. This type of charging unit is especially useful when charging Verde film at the slow process speeds near 0.01 inches per second. If exposure to visible and ultraviolet light is not limited, streaks tend to appear in the Verde film. The Verde film contemplated for use is of the type disclosed in U.S. Pat. No. 5,411,825 which is incorporated herein by reference.

Conductive plate 40 is biased by grounded battery 10 to a voltage of −110 V while conductive plate 45 biased by grounded battery 12 to a voltage of −90 V. A corona emission coronode 25 of about 1.5 mil diameter wire is energized by an energy source 30 through a resistor 31 in order to deflect and direct ions out of the slit formed by plates 40 and 45. Positioned beneath the conductive plates is grounded conductive charge receptor 50 that is grounded. Charge receptor 50 could be a migration imaging member as disclosed in aforementioned U.S. Pat. No. 5,411,825. Conductive plate slit forming edge 46 is preferably spaced about 0.06 inches away from receptor 50 and 0.06 inches away from slit forming edge 44 while coronode 25 is spaced about 0.12 inches away from conductive plate slit forming edge 44. A low impedance filter in housing 60 allows replacement air to enter housing 21 and thereby assure a clean positive airflow that prevents toner and paper dust from entering the device while replacing air leaving the device due to corona winds effect. Verde film as the charge receptor 50 is charged to a surface potential of 100 volts (charge density equal to 100 $nC/cm^2$) at a surface speed of 0.1 cm/sec. To ensure charging without undue exposure of light, conductive plates 40 and 45 are separated such that the planes of the plates and their near edges 44 and 46 are in the vertical plane of coronode 25.

Figure 2:
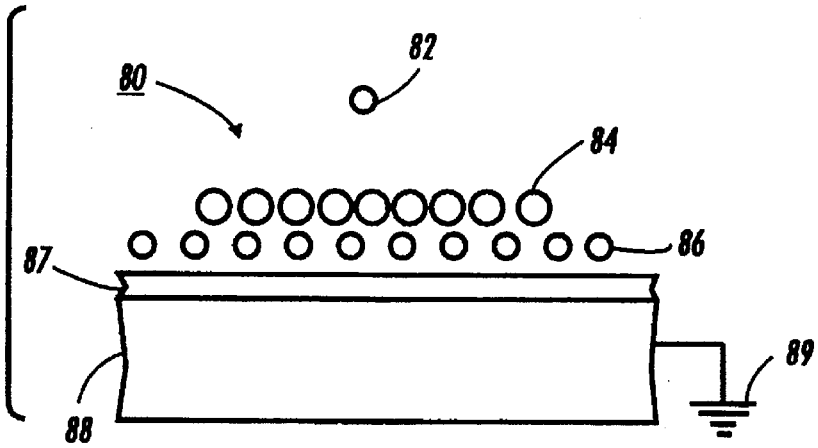
FIG. 2 is an enlarged side view of an alternative charging unit in accordance with the present invention.

Low efficiency in charging a receptor at slow speed without corona exposure can also be attained with the apparatus 80 shown in FIG. 2 which comprises a corona source 82 positioned above multiple eclipse wires or rods 84, spaced so that their shadows fall in the spaces between a control grid 86 of parallel screen wires, or the like. The control grid 86 can comprise long wires, strung parallel, or a planar grid with slits in the shadow areas of the eclipse rods. A receptor surface 87 supported on grounded member 88 is positioned to be charged by ions emitted by coronode 82. While light eclipse in member 84 is insulating and grid member 86 conductive in FIG. 2, it should be understood that light eclipsing member 84 could be conductive with grid member 86 being insulative, or light eclipsing member 84 could be conductive and grid member 86 insulative, or both the eclipse member 84 and grid member 86 could be conductive, if desired.

Figure 3:
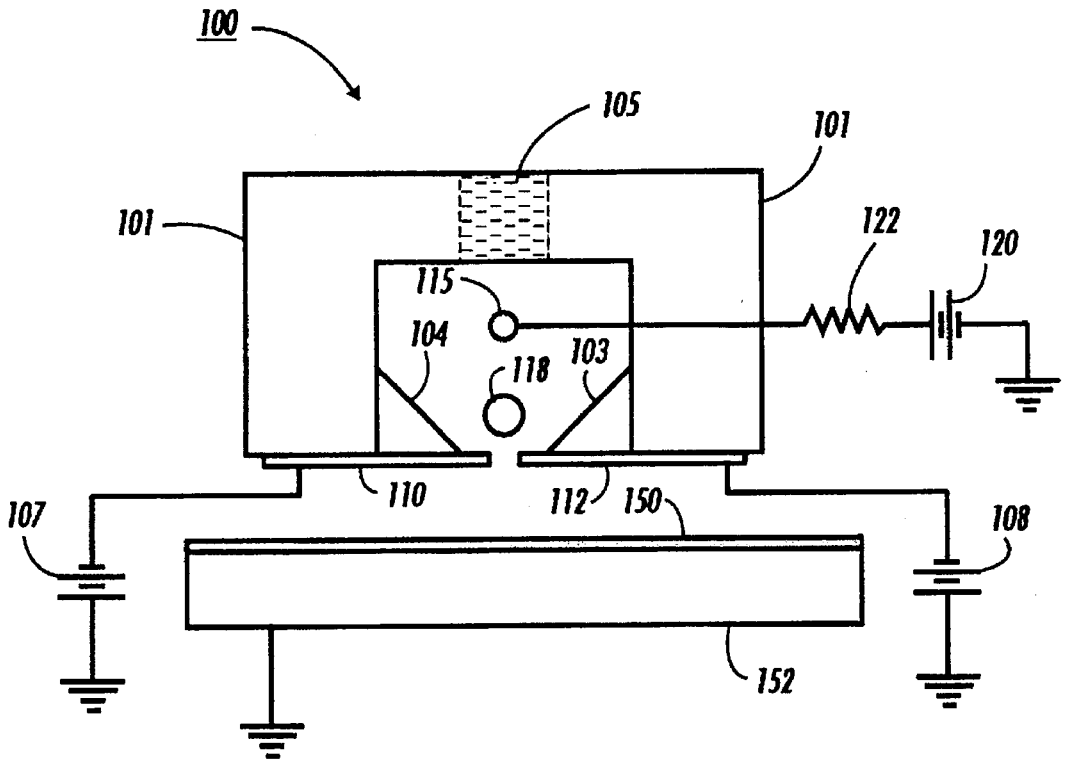
FIG. 3 is an enlarged side view of another embodiment of the present invention that includes wedges to focus ions toward a slit.

An alternative embodiment and a novel charging unit 100 in accordance with the present invention is shown in FIG. 3 and comprises an insulating housing 101 of a material such as plexiglass. Conducting electrodes 110 and 112 are attached by conventional means to housing 101 and define a slit or opening through which ions from coronode 115 are emitted. A positive high voltage power supply 120 furnishes the current that flows through resistor 122 supplying energy to coronode 115. A charge retentive surface 150 is mounted on grounded conductive substrate 152. If desired, coronode 115 can be a wire, pins or a ribbon. A light eclipsing element 118 is juxtaposed between coronode 115, the slit formed by electrodes 110 and 112, and charge receptor 150.

Eclipse element 118 blocks the corona generated light from coronode 115 without unduly affecting the performance of the charging unit. That is, the eclipse element prevents light emitted from the coronode from exiting the slit. The eclipse element 118 also deflects the charged particle stream away from the direction of the slit. This can be accomplished either by biasing eclipse element 118 to the same polarity as coronode 115, or by constructing it from a semi-conductive or insulating material. When constructed from an insulating material, charge accumulating on the surface of the eclipse element will further deflect the charged particle stream from a direct line path toward the slit. An advantage of a conductive and electrically biased eclipse element is that the bias can be adjusted, allowing for process control of the exact path of the streams of charge particles. The shape, structure and other properties of the eclipse element may vary, such as oval, pointed, etc. for optimum ion pumping action and it could be biased to drive ions toward the slit.

As seen in FIG. 3, a pair of insulating wedges 103 and 104 are positioned inside housing 101 with conducting electrodes 110 and 112 attached thereto and form a slit through which ions pass. Energy is applied to conducting electrodes 110 and 112 through grounded batteries 107 and 108, respectively. While eclipsing element 118 blocks corona light, it divides the ion streams into separate sheets of charges. Insulating wedges 103 and 104 focus both of the ion sheets into two channels, one on each side of the eclipsing element. The insulating wedges 103 and 104 focus and deflect the ion streams back toward and out of the slit, where they are driven to receptor 150 until the receptor voltage matches that of the slit. The insulating wedges acquire charges that produce fields to drive additional ions toward and into the slit. At the slit edges (inside) there are additional fringe fields that aid in pumping ions out of the slit. Since the charging unit of the present invention has fields that are directed toward the slit, there is a preferred air flow toward and out of the slit. By allowing replacement air to enter through low impedance filter 105, a clean, positive air flow is assured.

Figure 4:
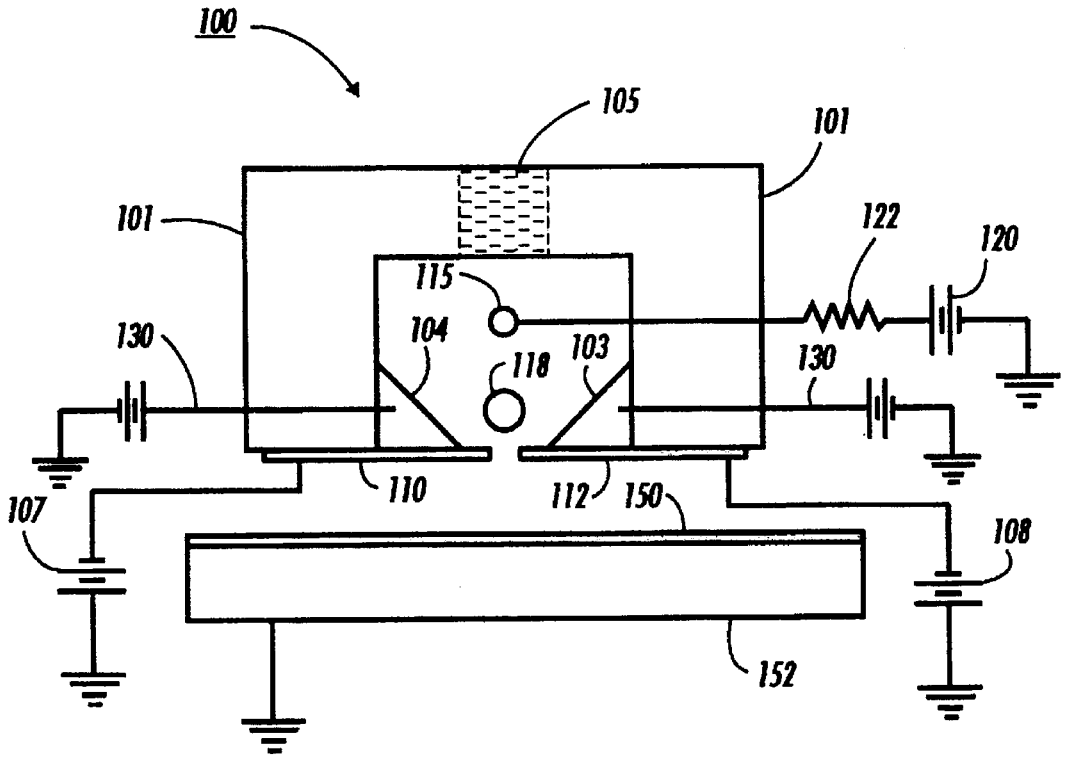
FIG. 4 is an enlarged side view of the embodiment of the present invention in FIG. 3 with biased conductive focusing wedges.

While the wedges 103 and 104 are shown as insulating in FIG. 3, it is a part of the present invention that the wedges could be conductive or semi-conductive, if desired, as shown in FIG. 4. The conductive or semi-conductive wedges 103 and 104 are biased at 130 and 135 to drive ions from coronode 115 to the lower potential of slit forming electrodes 110 and 112.

Figure 5:
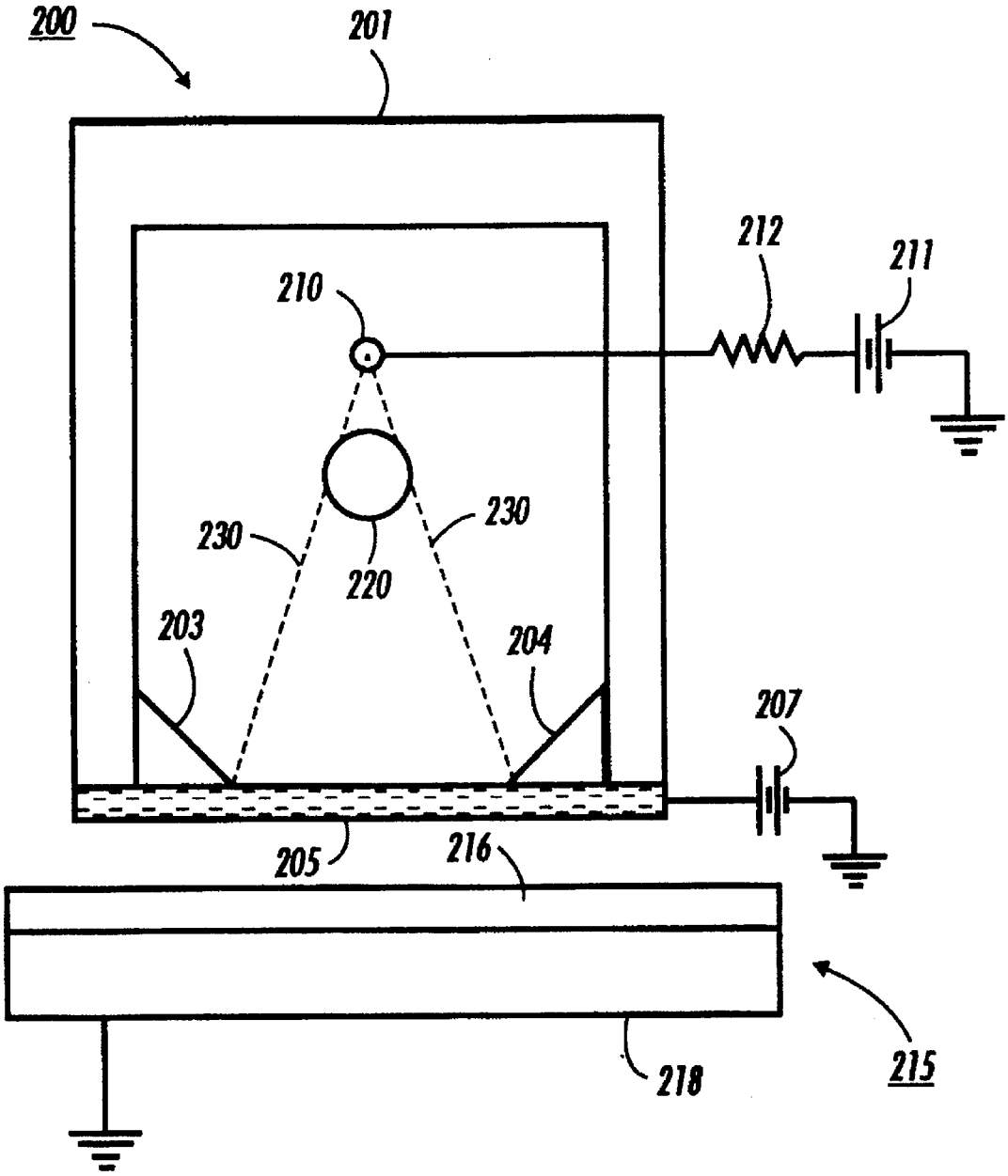
FIG. 5 is an enlarged side view of another embodiment of the charging unit of the present invention that employs a screen electrode.

Yet another alternative embodiment 200 of the present invention is shown in FIG. 5 that includes an insulating housing 201 with an open area that is enclosed by a conductive screen 205 that is biased at 207. A coronode 210 biased at 211 through resistor 212 is positioned within the housing and above screen 205 to emit ions toward a photoconductive member 215 having a charge receptive surface 216 mounted on a conductive substrate 218. Wedges 203 and 204 are positioned with respect to housing 201 and screen 205 to focus ions from coronode 210 toward screen 205. Corona light from ion source 210 is totally prevented from reaching charge receptive surface 216 by insulating eclipse 220 while considerable charge is still able to be driven to charge receptive surface 216. It should be understood that eclipse member 220 could be conductive, as well as, a wire with insulating overcoating and a bias could be applied to the conductive core of the eclipse. Dashed lines 230 from coronode 210 indicate boundaries of the corona light regions, so clearly, no light reaches screen 205. The focusing wedges 203 and 204 push the ion streams from coronode 210 away from the wedge surfaces and directs them to the screen. While light blocking eclipse rod 220 is usable with slow moving film to prevent corona light exposure of the film prior to the charging step, it is equally useful in all other scorotron applications. Also, when focusing the ion streams together at a slit region, some charges get lost to the large solid, conductive, slit forming electrodes as in FIG. 4. With the scorotron apparatus of FIG. 5 that incorporates eclipse rod 210, focusing requirements are eased and greater open areas to drive ions to the charge receptor surface is accomplished, thereby enhancing efficiency.

It should now be apparent that a novel charging apparatus has been disclosed for charging charge retentive surfaces, and especially for charging film requiring a process speed of less than 4 inches per minute that comprises a means for preventing fogging (exposure) of the film by corona light emissions.

While the invention has been particularly shown and described with reference to preferred embodiments thereof, it will be understood by those skilled in the art that various changes in form and details may be made therein without departing from the spirit and scope of the invention.

What is claimed is:

1. A scorotron charging apparatus adapted to uniformly charge a charge retentive surface with either positive or negative ions, said charging apparatus including:

a substantially enclosed insulating housing including a bottom surface;

only two reference electrodes attached to said bottom surface of said insulating housing, said two reference electrodes being mounted offset and in separate horizontal planes and forming a slit; and a coronode within said insulating housing adapted to emit ions through said slit onto said charge retentive surface.

2. The scorotron charging apparatus of claim 1, wherein said slit forming pair of reference electrodes include edge portions that are near each other where said slit is formed, and wherein said edge portions of said pair of reference electrodes are in a vertical plane through said coronode.

3. The scorotron charging apparatus of claim 1, wherein said pair of reference electrodes form a vertical slit.

4. The scorotron charging apparatus of claim 2, wherein one of said pair of reference electrodes is biased to about −110 V with the other of said pair of reference electrodes being biased to about −90 V and said charge retentive surface being biased to about −100 V.

5. A scorotron charging apparatus, comprising:

a coronode; a grid member having spaces therein; and a light eclipsing member positioned between said coronode and said grid member with said light eclipsing member having shadows therefrom falling in said spaces of said grid member.

6. The scorotron charging apparatus of claim 5, wherein said grid member is a screen and said light eclipsing member comprises multiple wires.

7. The scorotron charging apparatus of claim 5, wherein said grid member and said light eclipsing member comprise a series of rods.

8. The scorotron charging apparatus of claim 7, wherein said series of light eclipsing rods have a larger diameter than said coronode.

9. The scorotron charging apparatus of claim 5, including an insulating housing member.

10. A scorotron charging apparatus adapted to uniformly charge a surface of a charge receptor substrate with either negative or positive ions, said scorotron charging apparatus, comprising:

a substantially enclosed insulating housing including a bottom surface;

electrode means positioned on said bottom surface of said insulating housing and adapted to form a slit therein;

coronode means within said insulating housing adapted to emit ions through said slit onto said charge receptor substrate, said insulating housing having wedge shaped interior portions that are slanted toward said slit so as to focus additional ions from said coronode means to the center of said slit and thereby increase the efficiency of said scorotron charging apparatus; and a light blocking member positioned beneath said coronode, said light blocking member being adapted to block corona generated light emitted by said coronode to prevent fogging of said charge receptor substrate.

11. The scorotron charging apparatus of claim 10, wherein said coronode means is a wire.

12. The scorotron charging apparatus of claim 11, wherein said light blocking member is larger in diameter than said coronode means.

13. The scorotron charging apparatus of claim 12, wherein said coronode and said light blocking member are biased to the same polarity.

14. The scorotron charging apparatus of claim 10, wherein said wedge shaped interior portions of said insulating housing are conductive.

15. The scorotron charging apparatus of claim 10, wherein said wedge shaped interior portions of said insulating housing are semi-conductive.

16. The scorotron charging apparatus of claim 10, wherein said light blocking member is comprised of a semi-conductive material.

17. The scorotron charging apparatus of claim 10, wherein said light blocking member is comprised of an insulating material.

18. The scorotron charging apparatus of claim 10, wherein said wedge shaped interior potions are insulating.

19. The scorotron charging apparatus of claim 10, wherein said light blocking member is comprised of a conducting material.

20. A scorotron charging apparatus adapted to uniformly charge a surface of a charge receptor substrate with either negative or positive ions, said scorotron charging apparatus, comprising:

a substantially enclosed insulating housing including a bottom surface;

screen electrode means positioned on said bottom surface of said insulating housing;

coronode means within said insulating housing adapted to emit ions through openings in said screen and onto said charge receptor substrate, said insulating housing having wedge shaped interior portions that are slanted toward said screen so as to focus additional ions from said coronode means to the center of said screen and thereby increase the efficiency of said scorotron charging apparatus; and a light blocking member positioned beneath said coronode, said light blocking member being adapted to block corona generated light emitted by said coronode to prevent fogging of said charge receptor substrate.

21. The scorotron charging apparatus of claim 20 wherein said coronode means is a wire.

22. The scorotron charging apparatus of claim 20, wherein said light blocking member is conductive and biased.

23. The scorotron charging apparatus of claim 22, wherein said light blocking member includes an insulating coating thereon.

* * * * *